US007445879B2

(12) United States Patent
Hsieh et al.

(10) Patent No.: US 7,445,879 B2
(45) **Date of Patent: *Nov. 4, 2008**

(54) PREPARATION OF SUSPENSION POLYMERIZED TONERS

(75) Inventors: Bing R. Hsieh, Webster, NY (US); William A. Donofrio, Webster, NY (US)

(73) Assignee: Nukote International, Inc., Rochester, NY (US)

( * ) Notice: Subject to any disclaimer, the term of this patent is extended or adjusted under 35 U.S.C. 154(b) by 511 days.

This patent is subject to a terminal disclaimer.

(21) Appl. No.: 11/209,454

(22) Filed: Aug. 23, 2005

(65) Prior Publication Data

US 2007/0048655 A1 Mar. 1, 2007

(51) Int. Cl.
*G03G 5/00* (2006.01)

(52) U.S. Cl. ..... 430/137.15; 430/137.18; 430/137.19

(58) Field of Classification Search ..... 430/137.15, 430/137.18
See application file for complete search history.

(56) References Cited

U.S. PATENT DOCUMENTS

| | | | | |
|---|---|---|---|---|
| 4,912,009 | A | 3/1990 | Amering et al. | |
| 5,262,269 | A * | 11/1993 | Nair et al. | 430/137.17 |
| 5,283,149 | A | 2/1994 | Tyagi et al. | |
| 5,298,355 | A | 3/1994 | Tyagi et al. | |
| 5,591,552 | A | 1/1997 | Ciccarelli et al. | |
| 5,667,929 | A | 9/1997 | Ciccarelli et al. | |
| 6,287,742 | B1 | 9/2001 | Yoon | |
| 6,395,445 | B1 * | 5/2002 | Toth et al. | 430/137.14 |
| 6,458,502 | B1 | 10/2002 | Nakamura et al. | |
| 6,461,783 | B1 | 10/2002 | Kim et al. | |
| 6,531,255 | B2 | 3/2003 | Kim et al. | |
| 6,544,705 | B2 | 4/2003 | Kim et al. | |
| 7,247,416 | B2 * | 7/2007 | Hsieh et al. | 430/137.19 |
| 2004/0161687 | A1 | 8/2004 | Kim | |

OTHER PUBLICATIONS

U.S. Appl. No. 10/878,860, filed Jun. 28, 2004, Thompson.

* cited by examiner

*Primary Examiner*—Mark A Chapman
(74) *Attorney, Agent, or Firm*—Fay Sharpe LLP

(57) ABSTRACT

The invention relates to a process for the preparation of a dry toner powder containing a wax component and formed using a limited coalescence suspension polymerization process. Both conventional and aqueous dispersed waxes may be used to form the toner particles. Likewise, both dry and aqueous dispersed pigments may be used. The resulting toner provides properties desired in the next generation of toners including small uniform particle size as well as desirable anti-blocking and high-temperature anti-offset properties.

18 Claims, No Drawings

PREPARATION OF SUSPENSION POLYMERIZED TONERS

BACKGROUND

The present exemplary embodiments relate to a color toner composition, and to a limited coalescence suspension polymerization process for the preparation thereof. It find particular application in the production of a toner for use in developing an electrostatic image by electrophotographic, electrostatic recording and printing processes.

Present day toners are formulated from a range of potential components. Most toner compositions include at least a polymeric binder material and a colorant. Other commonly used components include black and colored magnetic oxides, charge control agents, internal additives to augment toner properties, such as aiding in deagglomeration and homogeneous distribution of the colorant in the toner composition, and external additives, to aid in the proper function of the toner. The components used in a particular toner formulation are dependent on the requirements of the machine in which the toner is ultimately intended to be used. For instance, the toner formulation must take into account such parameters as image quality, reliability, carrier life, toner shelf life, etc., all of which are intricately involved with the mechanical capability and design of the hardware of the machine.

Often, there is more than one component of a toner formulation which performs to eradicate certain undesirable properties of the toner. These same components may however, also contribute to other problems, or the combination of two or more components which affect the same toner properties may result in over-correction of a problematic area in the toner performance. Therefore, the combination of components selected to comprise a given toner composition must be carefully balanced, taking into account the full range of toner performance parameters which may be affected by each component and the interaction of each component with every other component of the toner composition, and the machine and its various components and systems.

Given that each of the foregoing parameters will affect toner performance in some manner, it is unlikely that any one toner will achieve optimum performance in all areas. Therefore, toner producers determine which parameters are most critical to the performance of a toner for a given purpose and which may be compromised, and to what extent.

Toner performance is determined by the combination of components, and by the physical, electrical and chemical properties of each. Such properties include pigment dispersion, particle size, particle size distribution, particle shape, bulk density, mechanical strength, flow properties, triboelectric charge, resistivity, softening point, blocking temperature, melt viscosity, and dispersion. Each of these parameters must be considered for each component in determining what components to combine and how to combine the components to achieve a balanced toner which produces an image having those properties determined to be most important for a specific toner. This choice of components is further influenced by economic and environmental concerns.

The bulk polymeric material of the toner generally functions as the binder for the colorants included in the toner formulation, but also affects many of the other toner functions, such as charging, electrical resistivity, and mechanical integrity, to name a few. Therefore, often times a combination of resins is used to achieve the desired performance. Polymers generally used in toner may be linear, branched or cross linked, and are chosen for their various properties and the manner in which these properties are likely to affect toner performance. For example, certain binder polymer properties affect the thermal performance of the toner. These properties include such binder parameters as glass transition temperature, melt viscosity, blocking temperature, and thermal integrity. In the same manner, the mechanical properties of the binder polymer, including such parameters as impact strength, adhesive/cohesive strength, and surface energy will also affect toner performance. Electrical traits such as triboelectric charge function, resistivity, and dielectric constant, and other miscellaneous features, such as moisture resistivity, % volatility, molecular weight, colorlessness, and pigment compatibility, all have an affect on the ultimate performance level of the toner in which the binder is used.

Among the most popular resins from which the toner resin may be selected are: acrylic resins, epoxy resins, polyamide resins, polyester resins, polyethylene resins, polystyrene resins, styrene-acrylic copolymer resins, and styrene-butadiene resins. As with all toner components, choice of resin is generally determined by the machine parameters and toner performance qualities sought.

Dispersed in the binder resin are the colorants used in the toner formulation. In monocomponent toners, magnetic oxide pigments are used for the purpose of enhancing the magnetic attraction between the toner and the developer roll assembly. Carbon black has historically been the most popular colorant used in black toners, as it strongly influences the triboelectric charging capability of the toner. However, more recent toners employ charge control agents to achieve and control this toner feature, thus allowing the use of more easily dispersed black colorants. The black colorant may also affect the flow characteristics of the toner and, therefore, is sometimes added in incremental amounts to the toner surface.

The charge control agents are also critical in full color printing. The equipment of today allows the reproduction of beautiful, photographic-quality full color images. The printer/copier machines generally employ one or more cartridges that dispense color toner, as well as black toner. The basic color toners used are magenta, cyan and yellow, though any number of other color toners are available. Generally, however, variations in color and tone or shade are produced by the combined printed affect of a basic color set of toners.

Most toner formulations also include any one or more of a number of materials known commonly in the industry as additives. These are generally fine particles that are physically blended with the toner. They may be attached to the toner by electrical means, mechanical means, or by mere physical mixing. These additives may be added to influence flow control, charge control, cleaning, fixing, offset prevention, transfer, conductivity control, humidity sensitivity control, and carrier life stability. Common additive materials include silica, metal oxides, metal stearates, fluoropolymer powders, fine polymer powders, rare earth oxides, waxes, conductive particulates, magnetite, carbon, and titanates. Choice of additives is critical, however, given that many of the additives affect more than a single toner property.

Clearly, given the vast number of components available in the industry for use in toner compositions, and given the propensity for many of the components to enhance some properties and at the same time to deleteriously affect others, choice of components is not a routine matter.

For example, it is known, as was set forth earlier, to produce toner compositions that include pigment colorants. Such compositions may use carbon black. Other color toners may use color pigments commercially available from a number of sources. It is critical to the quality of the printed image that the pigment or colorant used be homogeneously dispersed within the toner particles. This can be difficult to achieve given the propensity of pigment particulates to agglomerate, causing void areas in the toner particles that result in uneven color in the printed image. For this reason, many toner products include dyes instead of pigments. One problem with the use of dyes, however, is the lack of lightfastness and color density of the printed image. In an effort to overcome the problems of pigment dispersion in toner, the pigment has been used in the wet cake form. U.S. Pat. Nos. 5,667,929 and 5,591,552 disclose such a process for toner preparation. In these disclosures, pigment in the wetcake form was added to a mixture of linear polyester and toluene to form a pre-dispersion. The water was flushed, or displaced, by a resin/toluene solution, and then the toluene removed to generate a crushed powder of resin and pigment. While this method does increase pigment dispersion to some degree, printed images using the toner nonetheless exhibit very average print quality.

Therefore, one aspect of concern, and the one of most importance to this invention, is that of pigment dispersion. In an optimum toner, each toner particle will be consistent with respect to performance, and will exhibit a uniform distribution of colorant, charge control agent, additives, etc. The degree to which this uniform dispersion is achieved affects the resulting triboelectric charge, color, yield, and finally the printed image.

An additional concern in toner preparation is that of generating content-uniform particles exhibiting small particle size, at or below about 15 microns, and a narrow particle size distribution. Particle size, and the reduction thereof, is becoming increasingly more critical in toner production processes as newer generations of high resolution printing and copying equipment are developed.

Shape of the particle can be another concern. The more uniform the shape and the smaller the particle size, the better the printed image. Several patents that disclose a means of controlling the shape and particle size of the toner particles include U.S. Pat. Nos. 6,287,742, 6,461,783, 6,531,255 and 6,544,705. In the 6,287,742 patent, particulate resin, a dry pigment and optionally a charge control agent are combined, and this mixture is melted until the resin is in the molten state. The mixture is dispersed in an organic medium in which the resin is insoluble. A surfactant is also included in the organic medium. Under shear force and elevated temperatures, toner particles exhibiting consistent spherical shape and small size/size distribution are generated. In the U.S. Pat. No. 6,461,783 patent the resin polymer and dry pigment or dye colorant are combined with a vaporizable plasticizer which is then vaporized off after the mixture is subject to high shear mixing at elevated temperature. The vaporizing of the plasticizer introduces a surface roughness to the toner that aids in performance. While the forgoing achieve good results with respect to toner particle size/size distribution and shape, the disclosures nonetheless fail to address the problem of satisfactory pigment dispersion within the toner particles. The use in these disclosures of conventional or dry pigment, which remains difficult to uniformly disperse even with the processing shown in these patents, results in toners of lesser quality with respect to lightfastness and color density.

One means to achieve homogeneous or uniform pigment dispersion is set forth in U.S. Ser. No. 10/878,860, filed Jun. 28, 2004, to our common assignee, the disclosure of which is incorporated herein by reference. In that disclosure, the pigment colorant is added to the toner composition in the form of an aqueous liquid pigment concentrate dispersion.

Incorporation of waxes inside toner particles enables not only the anti-blocking properties but also the high-temperature anti-offset properties without applying any release agent such as silicon oil to fusing rollers (see, e.g., U.S. Pat. No. 6,458,502). Canon first disclosed wax containing chemical toners prepared by suspension polymerization and use them in single component laser printers. The wax forms separated domains and are encapsulated by the toner binder resin. This type of toners has become widely used in desktop laser printers without using fuser roll oil. Wax incorporation has been adapted by Avecia and DPI solutions for making emulsion aggregation toners and chemically milled toners respectively (for example DPI's U.S. patent application Ser. No. 10/366,369). Kodak disclosed evaporative limited coalescence processes for making toners with waxes (see U.S. Pat. Nos. 5,283,149 and 5,298,355). We have not been aware of any use of aqueous pigment dispersions in combination with aqueous wax dispersions disclosures on wax-containing toners produced by a suspension polymerization process; see for example U.S. Pat. No. 4,912,009. We hereby propose wax-containing toners prepared by a suspension polymerization process.

In addition, the current inventors have determined an alternative means by which to achieve uniform pigment dispersion within toner particles with volume average diameter of less than 15 μm. This is accomplished using an aqueous pigment pre-dispersion in combination with the processing steps set forth herein, to produce a toner suitable for generating a printed image with enhanced brightness of colors, visual density and vividness of color, each of which is a direct result of the quality of the pigment dispersion incorporated into the toner. Further, these toners exhibit narrow charge distribution and narrow particle size distribution.

BRIEF SUMMARY

In one aspect, there is provided a suspension polymerization process for the preparation of a wax containing dry toner with improved pigment dispersion. The toner can be made using aqueous pigment dispersion concentrates with or without conventional pigments Likewise, two types of waxes can be used, conventional waxes and aqueous dispersed waxes. One proposed process includes the steps of a process for the preparation of a dry toner powder from an aqueous pigment concentrate dispersion, the process comprising: blending at least an aqueous-based pigment concentrate dispersion, an optional aqueous-based wax dispersion, and a resin mixture to produce a paste; charging the paste to an extruder and compounding the paste at a temperature of up to about 150° C. to generate an extruded pigment/resin mixture; dispersing the extruded pigment/resin mixture in a vinyl monomer mixture to create an organic phase wherein the resin is solublized; dispersing the organic phase in an aqueous phase containing a stabilizer, and mixing the organic phase and the aqueous phase under shear force to form an suspension of toner size droplets; heating the suspension to polymerize the vinyl monomers; and washing, drying, and collecting the particles for use as a dry toner powder.

DETAILED DESCRIPTION

The present exemplary embodiments relate to a toner for use in the printing and recording of images by electrophotographic and electrostatic processes. More particularly, the embodiments relate to a suspension polymerization process for producing wax containing toner. In various embodiments, there are provided toners and processes for the production and use thereof wherein the toner composition includes as a colorant an aqueous pigment concentrate dispersion. In other various embodiments, the wax used may be conventional waxes or aqueous dispersed waxes.

The toner composition includes a binder resin that may be selected from any of a number of known resins. Exemplary resin components include vinyl resins, including homopolymers or copolymers of two or more vinyl monomers; and polymeric esterification products of a dicarboxylic acid and a diol comprising diphenol. These resins are polymerized during the present toner production process from suitable monomer components. Exemplary vinyl monomers include styrene, p-chlorostyrene, unsaturated mono-olefins such as ethylene, propylene, buytlene, isobutylene, and the like; saturated mono-olefins such as vinyl acetate, vinyl propionate and vinyl butyrate and the like; vinyl esters such as esters of monocarboxylic acids, including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate and the like; acrylonitrile, methacrylonitrile, acrylamide, mixtures thereof; and the like. Examples of specific thermoplastic toner resins include styrene butadiene copolymers with a styrene content of from about 70 to about 95 weight percent. Additionally, cross linked resins, including polymers, copolymers, and homopolymers of the aforementioned styrene polymers may be selected.

Also, waxes with a molecular weight of from about 300 to about 7,000, such as polyethylene, polypropylene, paraffin waxes, polyamide waxes and various natural waxes can be included in or on the toner compositions as internal lubricants or fuser roll release agents. Further, reactive extruded polyesters can be selected as the toner resin.

The resin or resins are included in the toner composition disclosed herein in an amount of from about 60% to about 90% of the toner composition. Preferably the resin component is included as from about 60% to about 80% of the total toner composition.

In one embodiment, the resin particles may have a Tg of from about 50° C. to about 75° C. and an acid number below 30. The weight average molecular weight for the resin component may be between about 10,000 and about 100,000.

One or more pigments are included in the toner compositions of the present embodiments. These pigments may be in the form of conventional dry or wet-cake pigments or aqueous pigment dispersions.

Particularly well suited to the practice of the present embodiments are aqueous pigment concentrate dispersions, generally intended for use in liquid ink compositions or paints. Suitable dispersions may contain an aqueous medium into which the desired pigment has been dispersed. The dispersion may further include a surfactant component, or a polymeric pigment stabilizer, such as a water soluble acrylic copolymer. These additional components may be added to stabilize the pigment particles and to improve dispersibility of the pigment during processing. Other possible components of the dispersion include compounds such as propylene glycol, which may be included to enhance the viscosity of the pigment dispersion and to aid in pigment wetting. Suitable aqueous pigment concentrate dispersions in accord with the foregoing include those available commercially from Sun Chemical, such as Aquatone® Dispersions, Flexiverse Dispersions, Sunsperse 6000 Dispersions and Moisture Tone® Dispersions, as well as the dispersions available commercially from Clariant, such as the Hostafine Dispersion products, among others. These dispersions generally include about 30 wt % solids to about 50 wt % solids pigment, and are included as from about 5 wt % to about 30 wt % of the toner composition. Alternately, the aqueous pigment dispersion can be dried prior to its use in the toner production process.

Toners prepared using aqueous pigment dispersions may exhibit superior pigment dispersion compared to those prepared using dry or wet-cake pigments.

Examples of suitable dry pigments include carbon black like REGAL 330; magnetites, such as Mobay magnetites M08029, M08060; Columbian magnetites; MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100, or TMB-104; and the like. As color pigments, there can be selected cyan, magenta, yellow, red, green, brown, or blue pigments or mixtures thereof. Specific examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, CINQUASIA MAGENTA available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK, and cyan components may also be selected as pigments with the process of the present invention. These pigments may be used as dry powder or in the wet cake form.

As discussed above, the pigment should be included in the toner composition in an amount of from about 5 wt % to about 15 wt % of the toner composition [the pigment is included up to 15% which can be derived from 30% of pigment dispersion.

In addition to the pigment, the toner composition may also include other colorants which may be any of the known pigments suitable for use in toner and developer compositions. Though pigments are generally a more preferred colorant because of their light fast properties and the water content, some dye colorants may also be used. These additional colorants may be added to achieve special colors and/or to increase color density. Specifically, the additional colorant should be suitable for use with the recited or suggested resin component, and also compatible with the remaining components of the toner composition.

Charge control agents may be added to the toner for the purpose of making the toner product either more electronegative or more electropositive. Whether the toner needs to be made more electronegative or more electropositive is determined by several factors. Some of these include the electronegativity of the remaining toner components as combined, i.e., different colorants and resins may impart different charge characteristics to the toner composition. Also, the carrier, if one will be used, must be considered, as many carrier materials impart a charge to the toner composition. Further, the machine in which the toner is used may impart some charge to the toner, as will the operation thereof. The purpose of the charge control agent component of the toner is to stabilize the toner with respect to electrical charge and thus avoid problems of print quality, color balance, and fogging, which are associated with too much or too little charge on the toner particles. Charge control agents may be selected from quaternary salts, metal and non-metal dyes, chromium, cobalt and zinc complexes, nigrosines, positive and negative colorless polymers, metal chelates, and quaternary amines, depending on the particular requirements of the complete toner composition.

Examples of suitable commercially available charge control agents include the following: S-34, S-40, E-82, E-81, E-84, E-87, E-88 and E-89, all manufactured by Orient Chemicals, and TRH, T-77, T-95, and TNS-2, all manufactured by Hodogaya Chemical Co. Charge control agents offered by BASF, Hoechst/Clariant, Zeneca and others may also be found to be suitable. These and other similar commercially available charge control agents may be selected. Generally, the charge control agent is included in the toner composition as up to about 10% thereof, based on the weight of the toner.

The wax component to be used in the toner is preferably composed of at least one wax selected from the group consisting of polyolefin waxes, carnauba wax, candelilla wax, hydrogenated jojoba oil, rice wax, hydrogenated lanolin, meadowfoam oil, and derivatives thereof. Preferably, the polyolefin waxes include low molecular weight waxes such as polypropylenes and polyethylenes, such as EPOLENE N-15 commercially available from Eastman Chemical Products, Inc., and similar waxes. The commercially available polyethylenes may have a molecular weight of from about 300 g/mol to about 3000 g/mol, while the commercially available polypropylenes utilized for the toner compositions of the present invention may have a molecular weight of from about 4,000 g/mol to about 7,000 g/mol.

Low molecular weight wax materials are present in the toner composition of the present invention in various amounts, however, generally these waxes are present in the toner composition in an amount of from about 0 wt % to about 15 wt %, and preferably in an amount of from about 5 wt % to about 10 wt %, based on the weight of the toner.

As with the case of the pigment component, the wax component added to the toner composition may be in the form of a conventional wax or as an aqueous wax dispersion.

Particularly well suited to the practice of the present embodiments are aqueous wax dispersions. Suitable dispersions may contain an aqueous medium into which the desired wax has been dispersed as colloidal wax particles. The dispersion may further include a particulate stabilizer component, or a polymeric wax stabilizer. These additional components may be added to stabilize the wax particles and to improve dispersibility of the wax during processing. Other possible components of the dispersion include compounds such as propylene glycol, which may be included to enhance the viscosity of the wax dispersion and to aid in wax wetting. Suitable aqueous wax dispersions may be made by dispersing a functionalized wax in an aqueous medium under shear and, optionally, with the application of heat. These dispersions generally include about 30 wt % solids to about 50 wt % solids wax. Commercial aqueous wax dispersions include Unithox® series of ethoxylate molecules from Baker Petolite®. The Unithox ethoxylate molecules have both the hydrophilic alkane segments and hydrophobic ethylene oxide segments and are thus amphophilic and self-emulsifying. These properties are useful in helping to disperse a wide range of materials within the toner particles such pigments, resins, waxes, and charge control agents.

Plasticizers may also be included in the toner compositions. Useful plasticizers include both very low viscosity plasticizers and polymeric plasticizers that are liquid at room temperature. These low viscosity plasticizers can be used alone or as part of a mixture of low viscosity plasticizers. Typical examples of useful plasticizers include dimethylphthalate, dibutylphthalate, tributylphosphate, butylstearate, ethyleneglycolbutyletheracetate, diethyleneglycolethyletheracetate, and diethyleneglycolbutyletheracetate. The amount of plasticier included in the toner is preferably from about 0 wt % to about 5 wt %, based on the toner composition.

The toner of the present invention may further include external additives employed for the purpose of enhancing flowability of the toner product. The additive used may be a single component additive or may be a specific combination of additives, the combined use of which produces a special performance effect of the toner product. Additives may be selected from silicas, metal stearates, fluoropolymer powders, fine polymer powders, rare earth oxides, waxes, conductive particles, magnetite, carbon, and titanates, and other like compounds.

Post additive treatment agents, such as flowability enhancers of the type used in this toner product, result in deagglomeration of the toner particles in use, and enhanced stability during storage of the toner product. In selecting a flowability enhancing additive to be added to the toner product during a post-treatment step, it is important to consider these parameters: anti-caking; flowability; electrostatic charge; stability; coefficient of friction; transfer efficiency; photoreceptor release properties; hydrophobicity; storage stability; and others. The indication of these characteristics generally requires inorganic compounds of fine particle size and high surface areas. These additives are often treated to render them hydrophobic in order to overcome the drawbacks associated with their conventionally hydrophillic nature.

For example, as the post additive to be employed in production of a toner in keeping with the present invention there may be used a hydrophobic silica fine powder in combination with a hydrophobic titanium oxide powder. Preferably, the titanium oxide powder is a silane treated powder. Other suitable external additives, or post additives, may include but are not limited to the use of aluminum oxide; zinc oxide; cerium oxide; strontium titanate; iron oxide; ferrite powder; calcium carbonate; copper oxide; barium sulfate; lithopone; metal salts of fatty acids; powdered fluoropolymers; polytetrafluoroethylene; polyethylene powder; carbon black; silicon carbide; silicon nitride; and powdered or fine particle polymers.

Various methods may be used to produce the present toner compositions. In one embodiment, the pigment of the appropriate color may be added to a high intensity mixer along with the remaining toner components, including resin, wax, charge control agent, additional pigment and plasticizer.

When using a conventional wax, one proposed process involves (1) forming an organic dispersion of pigment, wax, vinyl monomer (typically styrene and acrylics), initiator, charge control agent; (2) forming an aqueous phase of water and particulate stabilizer; (3) dispersing the organic dispersion into the aqueous phase under high shear to give a suspension of organic droplets; (4) subjecting the suspension to polymerization conditions to form toner particles; (5) washing and drying the wet toner particles to give the final dried toner particles.

When using an aqueous wax dispersion containing a functionalized wax, one proposed process involves (1) forming an organic dispersion of pigment, functionalized wax, conventional wax (optional), vinyl monomer (typically styrene and acrylics), initiator, charge control agent; (2) forming an aqueous phase of water, colloidal wax particles and particulate stabilizers (the aqueous wax dispersion); (3) dispersing the organic dispersion into the aqueous phase under high shear to give a suspension of organic droplets; (4) subjecting the suspension to polymerization conditions to form toner particles; (5) washing and drying the wet toner particles to give the final dried toner particles.

In the first described process using a conventional wax additive, the organic dispersion is created by mixing together the pigment (which may be in the form of a dried pigment dispersion from an aqueous pigment dispersion concentrate or as a conventional particulate or cake form), the wax, the monomer, initiator, and charge control agent (if used). An aqueous phase of particulate stabilizer mixed in water is then added to the mixture and the resulting mixture sheared at a high rate.

In one embodiment, the initiator is added to the monomer and dissolved therein. The monomer or monomer mixture is then added to the reaction vessel along with the aqueous dispersion with high shearing agitation to obtain a suspension of monomer droplets. The heavy shearing forces reduce the size of the monomer droplets and during this time an equilibrium is reached. The size of the droplets is stabilized or limited by the suspending agent complex which coats their surfaces.

The mixture is then heated and stirred in the reaction vessel to polymerize the monomer droplets. The resulting polymer particles are isolated by filtration and can, if desired, be slurried with water to remove water-soluble impurities and free suspending agent complex. Alternately, upon achieving a suspension of toner particles in the desired size range, the reaction mixture may be allowed to cool, either at ambient temperature or by immersion in cold water, and the toner particles can be recovered by filtration. The particles may be further washed with a low boiling hydrocarbon solvent to remove the paraffin solvents, and then vacuum dried, leaving dry color toner powder.

Any suitable mixing equipment may be employed for mixing the components. An example of such equipment is a vessel equipped with an impeller-type agitator and a means of heating the content of the vessel. The temperature selected should ensure fluid-like behavior of the mixture. While any suitable temperature may be employed, preferred temperatures are in the range of at least about 100° C. to about 200° C.

Any suitable organic medium which does not interfere with the polymerization of the monomer, water mixable or low boiling points may be employed. Exemplary solvents include ethyl acetate, tetrahydrofuran, N,N-dimethyl formamide, acetone, N-methyl pyrrolidone, sulfolane ethylene glycol, and the like.

The organic dispersion may further include a surfactant which may be a non-ionic, a cationic or an anionic surfactant. Examples of such surfactants include copolymers of vinylpyrrolidonone, alkylated maleic acid copolymers, polymers containing ethylene oxide moieties, polymers containing propylene oxide moieties and sodium dodecylsulfate. The surfactant may be present in the organic dispersion in an amount of from about 0.2 wt % to about 15 wt %, based on the amount of organic phase present, while from about 1 wt % to about 10 wt % based on the amount of organic phase present is typical.

The mean particle size by volume of a toner in keeping with this processing may range from about 3 microns to about 15 microns, as measured on a Coulter Multisizer, depending upon the application and the requirements of the imaging machine in which the toner will be used. The resulting fine powder toner may be passed through an Air Classifier to selectively remove the ultra-fine particles, usually those of 5 microns or smaller, which may be detrimental to the xerographic imaging process.

The toner powder thus produced may then be post treated by blending the powder, as in a high intensity blender, with a combination of post additives, such as hydrophobic silane treated silica fine powder and hydrophobic silane treated titanium oxide powder. Of course, a single post additive agent may also be used. The skilled artisan will be able to determine what post additive or post additive combination will best suit the intended toner product. Treatment with the post additives may produce a toner powder with optimum flow properties for use in the intended printer/copier machine.

Although conventional dry pigments may be used in the present invention, it has been noted that certain advantages may be realized for a toner prepared from an aqueous pigment concentrate dispersion over that prepared from a dry pigment include a higher degree of pigment dispersion, a higher color density at an equal pigment loading, a reduced pigment loading at a desired color density, narrower particle size distribution and charge distribution. A reduced pigment loading is advantageous in reducing the amount of pigment exposed on the surface of a toner particle and thus narrowing the charge distribution. A reduced pigment loading should reduce fine particles of less than 3 microns and thus narrow the particle size distribution. A higher degree of pigment dispersion becomes advantageous for the preparation of smaller size toner particles (5-8 microns) which are needed for the new generation of high resolution laser printers and copiers. The use of an aqueous pigment concentrate dispersion becomes the method of choice for achieving the smaller size toner particles that show high color density, narrow charge distribution and particle size distribution.

EXAMPLE 1

This example uses an aqueous pigment dispersion concentrate with a conventional wax material. The aqueous pigment concentrate BFD-1121 Pigment Blue, which contains 30.8% pigment, 60% water and 9.2% acrylic polymer pigment stabilizer and available commercially from Sun Chemical, was used. The following materials were charged into a Henschel high intensity mixer: BFD-1121 concentrate (200 g), a styrene butyl acrylate copolymer resin (60 g), TRH (10 g), a charge control agent available commercially from Orient Chemicals, Ceralub P-40 (20 g), a polypropylene wax available commercially from Shamrock Technologies, Inc., and Cabosil M-5 silica fine powder (4 g), available commercially from Cabot Corporation. The foregoing components were blended in the mixer for 10 minutes at 2,000 RPM. The resulting blend was allowed to settle and excess water was decanted. The solid paste was then transferred to a Warner & Pfleiderer ZSK-30 twin-screw extruder and compounded at 150° C. at 400 RPM and at about 64% torque to form a pigment/wax/resin mixture. The mixture was passed through the extruder once more to make sure complete removal of water.

Into a 250 milliliter polypropylene bottle was added styrene (70 g), butyl methacrylate (60 g), a solution of 50 wt % of a styrene-n-butylmethacrylate resin in styrene (30 g), and the pigment/wax/resin mixture (48 g). The resulting mixture was shaken overnight with a Burrel wrist action shaker until the resin dissolved. AIBN 2,2'-azo-bisisobutyronitrile (1.5 g), VAZO 52 2,2'-azo-bis(2,4-dimethyl valeronitrile) (1.5 g), were then added to the mixture, which was subsequently homogenized with a Brinkmann homogenizer with a 20 TSM generator at 8,000 rpm for 1 minute to provide a pigment dispersion. An aqueous phase was prepared by mixing water (100 g), Ludox HS-30 (11 g, a dispersion of 30 wt % silica in water available from Aldrich), polyvinylamine (0.06 g), 2.5 wt % sodium dichromate solution (1.7 g), sodium chloride (2 g). The aqueous phase was homogenized (8,000 rpm) and a portion of the pigment dispersion (80 g) was then added. Homogenization was continued for 10 seconds to provide an o/w (oil-in-water) suspension.

The resulting mixture was then transferred into a 2 liter reaction kettle equipped with mechanical stirrer and condenser. A non-ionic surfactant solution (1 killogram, 2% Pluronic L43 weight average molecular weight 1,850) was then added to the aforementioned mixture. The resulting mixture was the heated at 75° C. for 16 hours, at 85° C. for 5 hours, and then transferred into a 4 liter beaker. The resulting toner was then washed with water (10×3L) and 0.1 N KOH solution (2×3L), sieved through a combination of 425 and 250 microns sieves, and freeze dried to provide a toner.

EXAMPLE 2

This example used an aqueous pigment dispersion concentrate with an aqueous dispersible wax, Unithox® 450 ethoxylate available from Baker Petrolite and a conventional wax. The following materials were charged into a Henschel high intensity mixer: BFD-1121 pigment concentrate (200 g), Unithox® 450 (20 g), a styrene butyl acrylate copolymer resin (60 g), TRH (10 g), a charge control agent available commercially from Orient Chemicals, Ceralub P-40 (20 g), a polypropylene wax available commercially from Shamrock Technologies, Inc., and Cabosil M-5 silica fine powder (4 g), available commercially from Cabot Corporation. The foregoing components were blended in the mixer for 10 minutes at 2,000 RPM. The resulting blend was allowed to settle and excess water is decanted. The solid paste was then transferred to a Warner & Pfleiderer ZSK-30 twin-screw extruder and compounded at 150° C. at 400 RPM and at about 64% torque to a pigment/wax/resin mixture. The mixture was passed through the extruder once more to make sure complete removal of water.

Into a 250 milliliter polypropylene bottle was added styrene (70 g), butyl methacrylate (60 g), a solution of 50 wt % of a styrene-n-butylmethacrylate resin in styrene (30 g), and the pigment/wax/resin mixture (48 g). The resulting mixture was shaken overnight with a Burrel wrist action shaker until the resin is dissolved. AIBN 2,2'-azo-bisisobutyronitrile (1.5 g), VAZO 52 2,2'-azo-bis(2,4-dimethyl valeronitrile) (1.5 g), were then added to the mixture, which was subsequently homogenized with a Brinkmann homogenizer with a 20 TSM generator at 8,000 rpm for 1 minute to provide a pigment dispersion. An aqueous phase was prepared by mixing water (100 g), Ludox HS-30 (11 g, a dispersion of 30 wt % silica in water available from Aldrich), polyvinylamine (0.06 g), 2.5 wt % sodium dichromate solution (1.7 g), sodium chloride (2 g). The aqueous phase is homogenized (8,000 rpm) and a portion of the pigment dispersion (80 g) was then added. Homogenization was continued for 10 seconds to provide an o/w (oil-in-water) suspension. The resulting mixture was then transferred into a 2 liter reaction kettle equipped with mechanical stirrer and condenser. A non-ionic surfactant solution (1 killogram, 2 percent Pluronic L43 weight average molecular weight 1,850) was then added to the aforementioned mixture. The resulting mixture was the heated at 75° C. for 16 hours, at 85° C. for 5 hours, and then transferred into a 4 liter beaker. The resulting toner was then washed with water (10×3 L) and 0.1 N KOH solution (2×3 L), sieved through a combination of 425 and 250 microns sieves, and freeze dried to provide a toner.

It is to be understood that the inventive aspects of the formulation as presented herein are equally applicable to all color toner formulations, and it is intended that the invention should be construed in keeping with and afforded the full breadth of coverage of the appended claims.

What is claimed is:

1. A process for the preparation of a dry toner powder from an aqueous pigment concentrate dispersion, the process comprising:

a) blending at least an aqueous-based pigment concentrate dispersion, an optional aqueous wax dispersion and a resin mixture to produce a paste;

b) charging the paste to an extruder and compounding the paste at a temperature of up to about 150° C. to generate an extruded pigment/resin mixture;

c) dispersing the extruded pigment/resin mixture in a vinyl monomer mixture to create an organic phase wherein the resin is solublized;

d) dispersing the organic phase in an aqueous phase containing a stabilizer, and mixing the organic phase and the aqueous phase under shear force to form an suspension of toner size droplets;

e) heating the suspension to polymerize the vinyl monomers and form toner particles;

f) washing, drying, and collecting the particles for use as a dry toner powder.

2. The process of claim 1 wherein the pigment comprises an aqueous pigment concentrate dispersion.

3. The process of claim 2 wherein the aqueous pigment concentrate dispersion further contains a pigment stabilizer.

4. The process of claim 2 wherein the aqueous pigment concentrate dispersion further contains a surfactant.

5. The process of claim 2, wherein the aqueous pigment concentrate dispersion comprises from about 30 to 50 wt % pigment and comprises from about 5 to 30 wt % of said toner particles.

6. The process of claim 1 wherein the resin mixture further comprises one or more toner components selected from the group consisting of an additional wax component, a charge control agent, an additional colorant, and a plasticizer.

7. The process of claim 6 wherein the resin mixture has a wax component comprising a low molecular weight wax selected from the group of polyolefin waxes, carnauba wax, candelilla wax, hydrogenated jojoba oil, rice wax, hydrogenated lanolin, meadowfoam oil, and derivatives thereof.

8. The process of claim 6 wherein the charge control agent is selected from the group of quaternary salts, metal and non-metal dyes, chromium, cobalt and zinc complexes, nigrosines, positive and negative colorless polymers, metal chelates, quaternary amines, and combinations thereof.

9. The process of claim 6 wherein the resin mixture further comprises up to about 5 wt % of a plasticizer.

10. The process of claim 9 wherein the plasticizer is a low viscosity plasticizer that is liquid at room temperature.

11. The process of claim 1 wherein said vinyl monomer mixture comprises at least one of styrene, substituted styrene, substituted acrylate, or substituted butadiene.

12. The process of claim 1 wherein said vinyl monomer mixture comprises at least one of styrene, substituted styrene, substituted acrylate, or substituted butadiene and an optional organic solvents such as ethyl acetate, tetrahydrofuran, N, N-d imethyl formamide, acetone, N-methyl pyrrolidone, sulfolane ethylene glycol, and the like.

13. The process of claim 1, wherein said the resin mixture comprises a resin having a weight average molecular weight of from 10,000to 100,000.

14. The process of claim 1 wherein the aqueous wax dispersion comprises a low molecular weight wax selected from the group of polyolefin waxes, carnauba wax, candelilla wax, hydrogenated jojoba oil, rice wax, hydrogenated lanolin, meadowfoam oil, and derivatives thereof.

15. The process of claim 1 wherein the mixture further comprises up to about 8 wt % of an additional colorant.

16. The process of claim 12 wherein the additional colorant is a dry pigment.

17. The process of claim 1 wherein the stabilizer is particulate silica or an organic surfactant.

18. The process of claim 1, wherein the resulting toner particles have a mean particle size of from 2 to 15 μm.

* * * * *